US005840265A

United States Patent [19]

Yamamoto et al.

[11] Patent Number: 5,840,265

[45] **Date of Patent: *Nov. 24, 1998**

[54] CARBON FIBERS AND PROCESS FOR THEIR PRODUCTION

[75] Inventors: Iwao Yamamoto; Akihiko Yoshiya, both of Kagawa, Japan

[73] Assignee: Mitsubishi Chemical Corporation, Tokyo, Japan

[ * ] Notice: The term of this patent shall not extend beyond the expiration date of Pat. No. 5,721,308.

[21] Appl. No.: 689,777

[22] Filed: Aug. 14, 1996

[30] Foreign Application Priority Data

Aug. 18, 1995 [JP] Japan ..... 7-233447

[51] Int. Cl.[6] ..... D01F 9/12

[52] U.S. Cl. ..... 423/447.2; 423/447.6

[58] Field of Search ..... 423/447.2, 447.1, 423/447.6

[56] References Cited

U.S. PATENT DOCUMENTS

| | | | |
|---|---|---|---|
| 4,923,648 | 5/1990 | Hara et al. | 264/29.2 |
| 5,213,677 | 5/1993 | Yamamoto et al. | 423/447.2 |
| 5,266,294 | 11/1993 | Schulz et al. | 423/447.2 |
| 5,348,719 | 9/1994 | Yamamoto et al. | 423/447.2 |
| 5,601,794 | 2/1997 | Yamamoto et al. | 423/447.1 |

FOREIGN PATENT DOCUMENTS

| | | |
|---|---|---|
| 0 166 388 | 1/1986 | European Pat. Off. . |
| 0 550 858 | 7/1993 | European Pat. Off. . |

*Primary Examiner*—Michael L Lewis
*Assistant Examiner*—Stuart L. Hendrickson
*Attorney, Agent, or Firm*—Oblon, Spivak, McClelland, Maier & Neustadt, P.C.

[57] ABSTRACT

Pitch based carbon fibers characterized in that their thermal conductivity is at least 1,000 W/m·K as measured at room temperature, their electrical resistivity is at most 1.2 $\mu\Omega$m, their tensile modulus is at least 95 ton/mm$^2$, their compression strength is at least 30 kg/mm$^2$, and the ratio of crack-free fibers to cracked fibers is from 5/95 to 30/70, where the crack-free fibers are fibers having no cracks in their cross section, and the cracked fibers are fibers having cracks in their cross section.

12 Claims, 4 Drawing Sheets

CARBON FIBERS AND PROCESS FOR THEIR PRODUCTION

The present invention relates to pitch based carbon fibers and a process for their production. The pitch based carbon fibers of the present invention are carbon fibers which show very high thermal conductivity by themselves. Carbon fibers having such high thermal conductivity are useful as structural materials for space ships for which dimensional stability and heat shock resistance are required, or as heat-dissipating materials for high energy density electronic devices.

High performance carbon fibers are generally classified into PAN-based carbon fibers prepared from polyacrylonitrile (PAN) as starting material and pitch-based carbon fibers prepared from pitches as starting material, and they are widely used as e.g. materials for aircrafts, materials for sporting goods and materials for buildings, by virtue of their properties such as high specific strength and high specific modulus of elasticity, respectively.

In addition to the above mechanical properties, high thermal conductivity is required for application to e.g. materials for space crafts for which heat shock resistance and dimensional stability under a large temperature distribution are required, or heat-dissipating materials for electronic devices for which high energy densification continues to progress. Thus, many studies have heretofore been made to improve thermal conductivity of carbon fibers.

However, the thermal conductivity of commercially available PAN-based carbon fibers is usually less than 200 W/m·K, and the electrical resistivity is larger than 6 $\mu\Omega$m.

On the other hand, it has been generally recognized that with pitch based carbon fibers, high thermal conductivity and low electrical resistivity can readily be accomplished as compared with PAN-based carbon fibers. However, the thermal conductivity of commercially available pitch based carbon fibers is usually less than 700 W/m·K, and the electrical resistivity is larger than 2 $\mu\Omega$m.

Recently, as an improved technique in this field, a method has been proposed, for example, in Japanese Unexamined Patent Publication No. 242919/1990 in which carbon fibers having low electrical resistivity are produced by regulating the softening point of the pitch, the spinning temperature, the infusibilizing method and the baking temperature. However, this technique is still inadequate for industrial production, since a pitch having a high softening point is spun at a high temperature, a very special infusibilizing method is employed in which nitric acid is used, and graphitization is carried out at a very high temperature substantially exceeding 3,200° C. Further, spinning is carried out at a high temperature, whereby fibers are likely to have defects caused by a decomposition gas, and the fiber strength has been low.

Japanese Unexamined Patent Publication No. 163319/1992 discloses that carbon fibers having high thermal conductivity can be obtained by carrying out infusibilization, carbonization and graphitization treatments while carrying out a very complicated multistage stretching treatment. However, when the thermal conductivity was made to be at least 1,000 W/m·K, the compression strength was as low as 26 kg/mm$^2$.

Further, Japanese Unexamined Patent Publication No. 257020/1994 proposes to obtain carbon fibers having high thermal conductivity by regulating the range of the glass transition temperature, the degree of the optical anisotropy and the quinoline-insoluble content of the pitch. However, the thermal conductivity was not sufficiently high at a level of 860 W/m·K.

As described above, carbon fibers having high thermal conductivity have been developed to establish a technology at a sacrifice of industrial productivity. However, conventional products are poor in the mechanical properties, particularly in compression strength. Accordingly, in the application field, insufficiency in strength has been pointed out, and the use has been thereby restricted. Thus, improvements have been required.

Accordingly, it has been desired to develop carbon fibers having high compression strength as well as very high thermal conductivity, low electrical resistivity and high tensile modulus, specifically carbon fibers having a thermal conductivity of at least 1,000 W/m·K, an electrical resistivity of at most 1.2 $\mu\Omega$m, a tensile modulus of at least 95 ton/mm$^2$, and a compression strength of at least 30 kg/mm$^2$, and an industrial process for their production.

The present inventors have conducted an extensive research on the basis that in order to obtain high thermal conductivity and low electrical resistivity, it would be necessary to increase the crystal structure of carbon fibers as large as possible and to bring it close to a single crystal of graphite, and in order to obtain high strength, it would be necessary to reduce defects in the carbon fibers as far as possible.

As a result, it has been found that high thermal conductivity and high strength can both be attained by regulating the ratio of fibers having no cracks to fibers having cracks in the cross section of carbon fibers within a certain specific range, and such carbon fibers can be obtained by a process wherein an optically anisotropic pitch is left to stand for a certain specific period of time at a certain specific viscosity immediately before spinning nozzles to permit the domain sizes of pitch liquid crystals (the sizes of the liquid crystal structures) to grow large, then directly introduced into nozzles in that state and discharged from the nozzles without imparting any shearing force to obtain pitch fibers as a precursor for carbon fibers, and the pitch fibers are then subjected to infusibilization, carbonization or graphitization. The present invention has been accomplished on the basis of these discoveries.

Namely, the present invention provides pitch based carbon fibers characterized in that their thermal conductivity is at least 1,000 W/m·K as measured at room temperature, their electrical resistivity is at most 1.2 $\mu\Omega$m, their tensile modulus is at least 95 ton/mm$^2$, their compression strength is at least 30 kg/mm$^2$, and the ratio of crack-free fibers to cracked fibers is from 5/95 to 30/70, where the crack-free fibers are fibers having no cracks in their cross section, and the cracked fibers are fibers having cracks in their cross section.

Further, the present invention provides a process for producing carbon fibers, which comprises introducing a molten optically anisotropic pitch into nozzles for spinning, and subjecting pitch fibers thereby obtained to infusibilization, carbonization or graphitization, wherein the molten optically anisotropic pitch is left to stand still for from 20 to 300 minutes in such a state that the viscosity is from 50 to 1,000 poise, and then the pitch is directly introduced into the nozzles for spinning.

Figure 1:
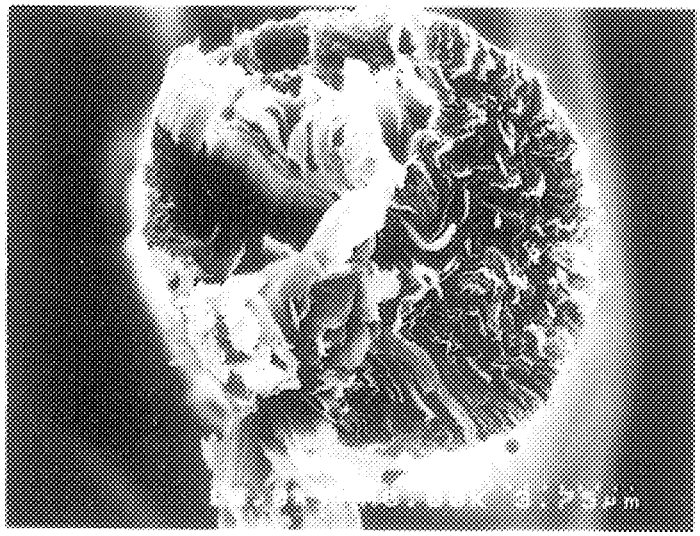
FIG. 1 is a cross sectional photograph of a carbon fiber having no cracks among carbon fibers of the present invention, as observed by a scanning electron microscope (SEM) with 8,000 magnifications.

Now, the present invention will be described in detail with reference to the preferred embodiments.

As starting material for spinning pitch to be used in the present invention, coal-based coal tar, coal tar pitch, a liquefied product of coal, petroleum based heavy oil, tar or pitch, may, for example, be mentioned. Among these materials, coal-based coal tar or coal tar pitch is suitably employed, since the constituting molecules have high aromatic nature, and it is possible to obtain spinning pitch wherein graphite crystallites will readily develop.

Such a carbonaceous material contains impurities such as free carbon, insoluble coal, an ash content and a catalyst. It is advisable to preliminarily remove such impurities by a conventional method such as filtration, centrifugal separation or sedimentation separation by means of a solvent. Further, the carbonaceous material may be subjected to pretreatment by e.g. a method wherein after heat treatment, a soluble content is extracted with a certain specific solvent, or a method wherein it is hydrogenated in the presence of a hydrogen donative solvent or hydrogen gas.

In the present invention, the optically anisotropic pitch as spinning pitch has an optical anisotropy of at least 70%, preferably at least 90%, more preferably 100%. If the optical anisotropy is less than 70%, the graphite crystallinity of carbon fibers after graphitization tends to be low, and it tends to be difficult to obtain high thermal conductivity.

Further, the softening point determined by a Metler method is usually from 260° to 340° C., preferably from 280° to 320° C., more preferably from 290° to 310° C. If the softening point is lower than 260° C., the fibers tend to fuse one another during infusibilization after spinning, and a strand of carbon fibers tends to have a poor fibrillating property. On the other hand, if it is higher than 340° C., heat decomposition of pitch is likely to occur at the time of spinning, whereby the spinning performance tends to be remarkably poor due to formation of bubbles in spinning nozzles due to the decomposition gas.

In order to obtain an optically anisotropic pitch having the desired optical anisotropy and Melter softening point, the above-mentioned carbonaceous material or the pretreated carbonaceous material, may be subjected to heat treatment usually at a temperature of from 350° to 500° C., preferably from 380° to 450° C., for from 2 minutes to 50 hours, preferably from 5 minutes to 5 hours, in an inert gas atmosphere such as nitrogen, argon or steam, or while blowing such an inert gas into the system.

In the present invention, it is important that the molten optically anisotropic pitch is left to stand still for from 20 to 300 minutes, preferably from 40 to 150 minutes, at a viscosity of from 50 to 1,000 poise, preferably from 100 to 500 poise, and then the pitch is directly introduced into nozzles for spinning without imparting a shearing force to divide the pitch domains.

Here, "stand still" is meant for not giving a flow velocity beyond natural convection due to the heat of the pitch, and the linear velocity is at most 2 cm/min. In order to carry out spinning continuously, it is necessary to continuously supply the pitch into the spinning apparatus, whereby the flow rate is required to be at most 2 cm/min as a linear velocity.

More specifically, at the time of spinning pitch fibers, it is common to provide a meshed filter, glass beads, a metal powder, a sintered metal filter at an up stream portion of nozzles in order to treat, remove or homogenize impurities or gelled heavy substances contained in spinning pitch. However, if such a packing is present in the flow path of pitch liquid crystal, the pitch crystal passing therethrough will be divided by space units of the packing, whereby the domain sizes will be reduced. If pitch is introduced into the nozzles for spinning under such a state, pitch fibers having fine crystal units will be obtained, and the thermal conductivity of carbon fibers obtained from such pitch fibers, will be low.

According to the present invention, pitch crystal which has been once divided into fine crystal units, is left to stand under the above-mentioned specific conditions, whereby pitch domains are permitted to grow again, and then the pitch liquid crystal is introduced directly into nozzles for spinning without exerting a shearing force to divide the pitch domains again i.e without passing it through the packing as described above, whereby pitch fibers having large domain sizes will be obtained. The cross sectional structure of such pitch fibers is different from a "radial type" which is commonly known. "The "radial type" shows a cross section of a fan shape with cracks formed in a radial direction due to high temperature treatment" (Sugio Otani et al., Carbon fibers, published by Kindai Henshu (1983) p. 197–198). Whereas, pitch fibers obtained by the present invention have large tissue structures, and when such pitch fibers are heat treated, carbon fibers having no cracks formed will be obtained in a certain proportion.

Figure 6:
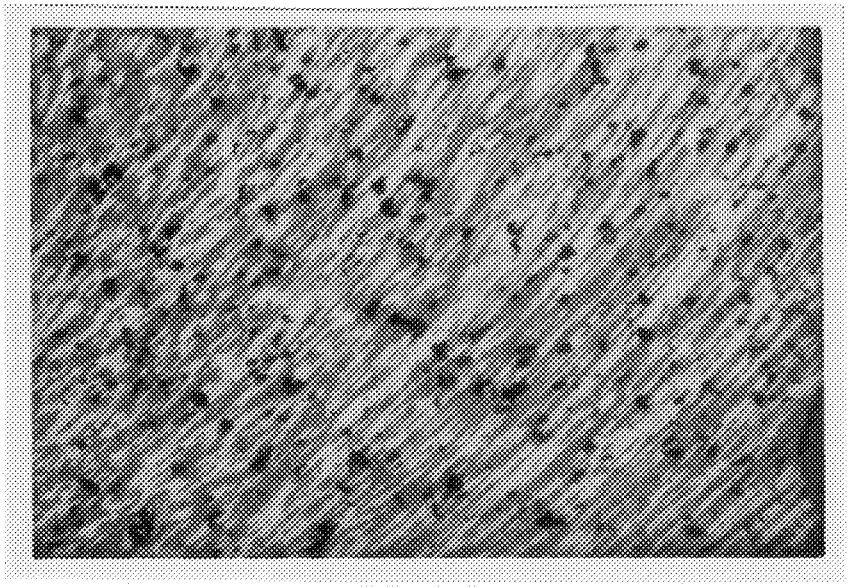
FIG. 6 is a polarization microscopic photograph showing domains which have been divided to have small domain sizes.
Figure 7:
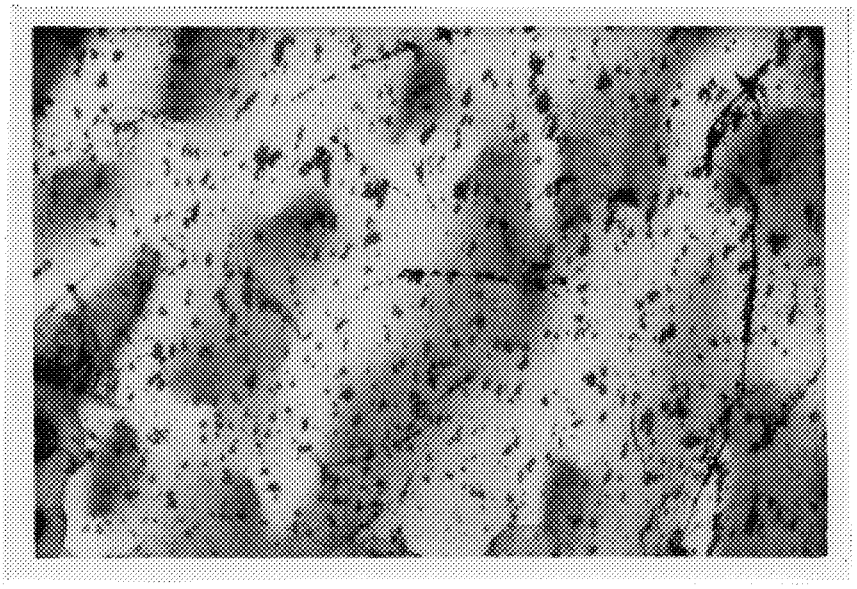
FIG. 7 is a polarization microscopic photograph showing domains grown to have large domain sizes.

A pitch domain represents one unit of repetition in orientation of pitch liquid crystals, and such a pitch domain can be observed by a change in color of blue, purple and yellow. A continuous color portion is regarded as one domain. The domain size means the width of one domain as measured in a vertical direction to the direction of orientation of pitch liquid crystals, on a certain plane. From a polarization microscopic photograph of the optically anisotropic pitch after being passed through the packing, it is seen that pitch domains have been divided to have smaller sizes (see FIG. 6). From a polarization microscopic photograph of the optically anisotropic pitch after being left to stand still for 60 minutes at a viscosity of 100 poise after being passed through the packing, it is seen that pitch domains have grown to have larger domain sizes (see FIG. 7).

If the viscosity at the time of being left to stand still is higher than 1,000 poise, it takes a long time for domains to grow large, and thus the efficiency tends to be poor. On the other hand, if it is lower than 50 poise, the temperature required to maintain the viscosity tends to be high, and a decomposition gas tends to form due to heat decomposition of pitch left to stand still, whereby it becomes difficult to carry out spinning under a stabilized condition.

Further, if the time for standing still is shorter than 20 minutes, growth of pitch domains tends to be inadequate, and if it is longer than 300 minutes, a decomposition gas tends to form due to heat decomposition of pitch left to stand still, whereby it becomes difficult to conduct spinning under a stabilized condition.

Figure 3:
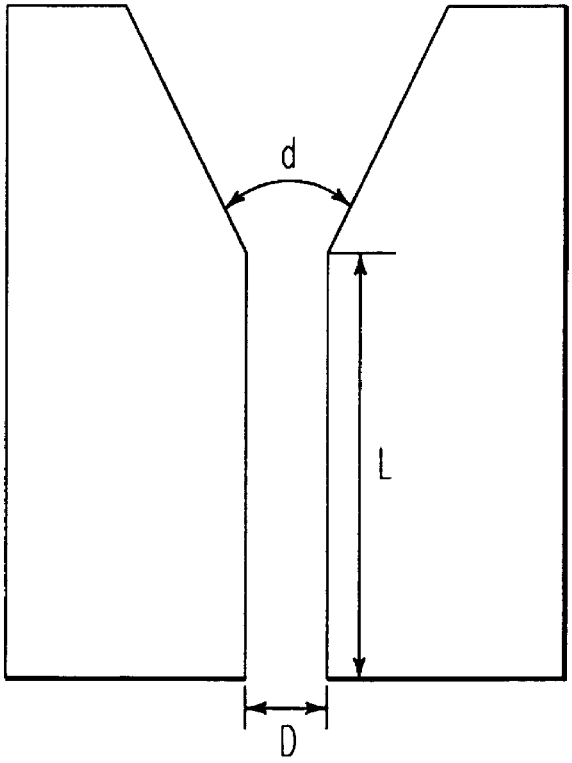
FIG. 3 is a diagrammatical view of the cross section of a spinning nozzle to be used in the process for producing carbon fibers of the present invention.

In the present invention, there is no particular restriction as to the shape of nozzles. However, it is preferred to employ a nozzle which has a nozzle hole inlet angel $\alpha$ of larger than 70° and a L/D ratio of smaller than 3 where L is the length of the nozzle hole and D is the diameter of the nozzle hole, more preferably a nozzle having an inlet angle α of larger than 100° and a L/D ratio of smaller than 1.5, as shown in FIG. 3.

The temperature of the nozzles during spinning is not particularly restricted, and it may be a temperature at which a stabilized spinning state can be maintained, i.e. a temperature at which the viscosity of spinning pitch is from 20 to 800 poise, preferably from 50 to 300 poise.

Pitch fibers thus obtained will be infusibilized in accordance with a conventional method, then carbonized and/or graphitized at an optional temperature, and subjected to surface-treatment to obtain carbon fibers of the present invention. Here, the higher the temperature for carbonization and graphitization, and the longer the time for carbonization and graphitization, the larger the graphite crystallites will grow to provide carbon fibers having high thermal conductivity.

Infusibilizing treatment is usually conducted in an oxidizing atmosphere such as air, ozone or nitrogen dioxide, or in an oxidizing liquid using e.g. nitric acid, as a rare case. As the most convenient method, it can be carried out in air.

Infusibilized fibers will be carbonized and/or graphitized at a temperature required to obtained carbon fibers having desired physical properties, followed by surface treatment. During such an operation, a tension may or may not be applied.

Specifically, pitch fibers are heat-treated at a temperature of from 300° to 380° C. in an oxidizing gas atmosphere to obtain an infusibilized fiber tow. Further, this infusibilized fiber tow is carbonized or graphitized usually at a temperature of from 800° to 3,500° C. an inert gas atmosphere of e.g. nitrogen or argon. This carbonization or graphitization treatment is preferably carried out at such a temperature that the carbon content of the resulting carbonized or graphitized fibers will be at least 97%, more preferably at least 99%. By the treatment at such a temperature, it is possible to minimize the dimensional change due to carbonization shrinkage of the carbon fibers and to prevent a decrease in the carbon fiber strength due to a damage to the fibers.

Then, surface treatment is conducted by a conventional method, and then a sizing agent is applied in an amount of from 0.2 to 10 wt %, preferably from 0.5 to 7 wt %, to the fibers, to obtain carbon fibers.

As the sizing agent, a commonly employed optional agent may be used. Specifically, an epoxy compound, a water-soluble polyamide compound, a saturated or unsaturated polyester, vinyl acetate, water, or an alcohol, glycol alone or a mixture thereof may be mentioned. Further, in the present invention, it is preferred that the carbonized or graphitized carbon fibers, or a fabric made of such carbon fibers, is put into a graphite crucible together with preliminarily graphitized packing coke, followed by high graphitization treatment.

The graphite crucible is not particularly limited with respect to the size or shape, so long as it is capable of accommodating a desired amount of the above carbon fibers or carbon fiber fabric. However, in order to prevent damages to the carbon fibers or carbon fiber fabric due to the reaction with an oxidizing gas or carbon vapor in the baking furnace during the graphitization treatment or during cooling, it is preferred to have a cover and high air-tightness.

The carbon fibers or carbon fiber fabric is charged into the graphite crucible as wound on a bobbin or a core material. The packing coke to be charged together into the graphite crucible, is the one preliminarily graphitized. Such a graphitization temperature is required to be at least at a temperature at which removal of the volatile component of the packing coke would be accomplished, and it is the one highly graphitized at a temperature of from 1,400° C. to 3,500° C., preferably from 2,500° C. to 3,500° C.

The particle size of the packing coke is from 0.1 mm to 100 mm, preferably from 5 mm to 30 mm, as an average particle size. The graphitization treatment is carried out at a temperature of from 2,500° C. to 3,500° C., preferably from 2,800° C. to 3,300° C., more preferably from 2,900° C. to 3,100° C.

As the equipment for the high graphitization treatment, it is particularly preferred to employ an Acheson resistance heating furnace from the viewpoint of production efficiency. However, there is no particular restriction, so long as the equipment is the one capable of treating at a temperature of at least 2,500° C. and the above-mentioned graphite crucible can be placed in the heating furnace.

The high graphitization time is such that the retention time at a temperature of at least 2,500° C. is from 30 minutes to 300 days, preferably from 1 hour to 30 days.

One of the factors governing the strength of carbon fibers, is the fibrillating property of the fiber tow, i.e. susceptibility to opening of the fiber tow. Good openability i.e. a state in which carbon fibers are present individually and independently in the tow, is important particularly to attain the strength as a composite material, for example, to attain compression strength.

To improve the openability, it is necessary to avoid fusion of fibers to one another during infusibilizing treatment. For this purpose, it is common to employ a method of slowing down the temperature raising rate during the infusibilizing treatment, a method of incorporating a spacer such as inorganic fine particles at the time of bundling pitch fibers so as to avoid physical contact of fibers, or a method of infusibilizing the fibers at a low temperature by means of an oxidizing gas such as nitrogen dioxide. Further, a method may also be employed wherein the fibers fused during the infusibilizing treatment are heat treated in an atmosphere prepared by mixing steam and an oxidizing gas such as carbon dioxide, during carbonization, to chemically remove the fusion.

The carbon fibers thus obtained are carbon fibers having ultra high thermal conductivity and high compression strength, which simultaneously have physical properties such that ① the thermal conductivity is at least 1,000 W/m·K, preferably at least 1050 W/m·K, as measured at room temperature, ② the electrical resistivity is at most 1.2 μΩm, preferably at most 1.15 μΩm, ③ the tensile modulus is at least 95 ton/mm$^2$, and ④ the compression strength is at least 30 kg/mm$^2$. Further, the cross sectional configuration of the carbon fibers is characterized in that the ratio of crack-free fibers to cracked fibers is from 5/95 to 30/70, where the crack-free fibers are fibers having no cracks in their cross section, and the cracked fibers are fibers having cracks in their cross section.

If the ratio of crack-free fibers to cracked fibers is less than 5/95, the compression strength tends to be inadequate, and if it exceeds 30/70, it tends to be difficult to obtain sufficiently high thermal conductivity.

Here, cracks are meant for cracks caused by high temperature treatment, as disclosed in the above-mentioned literature by Otani et al.

The carbon fibers obtained by the process of the present invention have large tissue structures especially at the center portion of the fiber cross section, since optically anisotropic pitch having high orientation, has been spun in a state where pitch domains have been adequately grown, without exerting a shearing force thereafter. The size of the tissue structures can be ascertained by observing the fiber cross section by a scanning electron microscope (SEM) under from 4,000 to 10,000 magnifications. From such observation, these tissue structures have been found to be constituted by crystallites laminated in a length of at least from 0.1 μm to 1 μm.

FIG. 1 shows a cross sectional photograph of a carbon fiber having no crack among carbon fibers of the present invention, as observed by SEM with 8,000 magnifications. This cross section is a section after tensile breakage, wherein crystallites well developed to a length of at least 1 μm are observed from the center portion toward the peripheral portion of the fiber.

Figure 2:
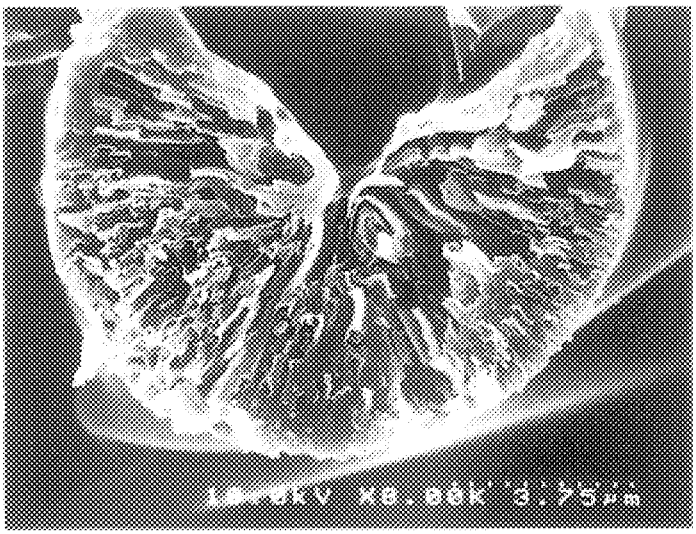
FIG. 2 is a cross sectional photograph of a carbon fiber having cracks among the carbon fibers of the present invention, as observed by SEM with 8,000 magnifications.

FIG. 2 shows a cross sectional photograph of a carbon fiber having cracks among carbon fibers of the present invention, as observed by SEM with 8,000 magnifications. This cross section is a cross section cut by a sharp knife, which shows large tissue structures, as is different from so-called "radial type".

It is generally accepted that "a fiber with a radial tissue having cutouts, has a high graphitization degree P1, wherein crystallites are grown to have large sizes, whereas a fiber with a radial tissue having no outputs, has a low graphitization degree, wherein growth of crystallites is not distinct" (Michio Inagaki et al., New Carbon Materials, published by Gihodo, p. 52). Here, "cutouts" means cracks. This phenomenon is attributable to the fact that by the formation of cracks, the stress formed by shrinkage of the graphite crystallites in the direction of lamination during graphitization, is relaxed, whereby growth of graphite crystallites is carried out under a free condition. The carbon fibers of the present invention take a structure which is basically different from the radial orientation. Nevertheless, from 95 to 70% of fibers have cracks and have tissue structures wherein graphite crystallites are developed.

The carbon fibers of the present invention contain carbon fibers having no crack which have heretofore been believed to have a low graphitization degree and to show no distinct growth of crystallites in an amount of from 5 to 30%. Nevertheless, as a pitch having domains adequately grown, is spun (see FIG. 7), crystallites tend to readily develop during baking, and they are able to take large tissue structures wherein graphite crystallites are developed. Accordingly, the carbon fibers of the present invention exhibit very high thermal conductivity and low electrical resistivity.

Fibers having cracks, have a high graphitization degree and thus are suitable to obtain high thermal conductivity. On the other hand, however, they tended to deteriorate the strength.

Whereas, the carbon fibers of the present invention take large crystal structures particularly at the center portion, as described above, and take a structure different from the radial structure having the fiber center as its center, whereby formation of cracks is suppressed, and fibers having a substantially circular shape in their cross section are contained in an amount of from 5 to 30%, and accordingly, the compression strength is high as compared with conventional carbon fibers having ultra high thermal conductivity.

Namely, by regulating the ratio of crack-free fibers to cracked fibers and by letting crack-free fibers have large tissue structures so that graphite crystallites can readily be developed, it is possible to attain both ultra high thermal conductivity and high compression strength.

Now, the present invention will be described in further detail with reference to Examples. However, it should be understood that the present invention is by no means restricted to the following Examples.

In the following Examples, the respective measurements were carried out by the following methods.

(1) Proportion of optical anisotropy

A pitch sample pulverized to a particle size of a few mm was embedded over substantially the entire surface of a resin with a diameter of 2 cm by a conventional method, and the surface was polished.

The entire surface was observed under a polarization microscope (100 to 600 magnifications), whereby the proportion of the area of the optically anisotropic portion in the entire surface area of the sample was measured.

(2) Softening point

The softening point was measured by means of a Metler softening point measuring apparatus. The starting temperature was set at a level of (expected softening point −20° C.), and the temperature was raised at a temperature raising rate of 1° C./min.

(3) Compression strength

The compression strength was measured in accordance with ASTM D3410. The measured value is a value calculated as the volume fraction (Vf) of the carbon fibers being 60%.

(4) Interlaminar shear strength

The interlaminar shear strength was measured in accordance with ASTM D2344. This was a short beam three point bending test, and the size of the test piece was 10 mm in width, 2 mm in thickness and 12 mm in length.

(5) Observation of the cross sectional shapes of the fibers

About 4,000 carbon fibers were embedded in a resin, and the surface was polished. Then, the cross sectional shapes of the fibers were observed under a microscope (500 magnifications), whereby the proportion of the fibers having cross sectional shapes being substantially circular, in the total number of fibers, was taken as the proportion of crack-free fibers, and the proportion of the rest of fibers was taken as the proportion of cracked fibers.

(6) Electrical resistivity

The electrical resistivity was measured by a four terminal method. The distance for measuring the resistivity was 500 mm.

(7) Thermal conductivity carbon fibers were made into a disk-shaped one directional carbon fiber reinforced plastic (CFRP) having a diameter of 10 mm and a thickness of from 3 to 6 mm, and the specific heat and the diffusivity of heat of the CFRP were measured by thermal constant measuring apparatus TC-3000 by laser flash method, manufactured by Shinkuriko K. K., whereupon the thermal conductivity was calculated by the following formula:

$$K=Cp\cdot\alpha\cdot\rho/Vf$$

where K is the thermal conductivity of the carbon fibers, Cp is the specific heat of the CFRP, α is the diffusivity of heat of the CFRP, ρ is the density of the CFRP, and Vf is the volume fraction of the carbon fibers contained in the CFRP.

Figure 4:
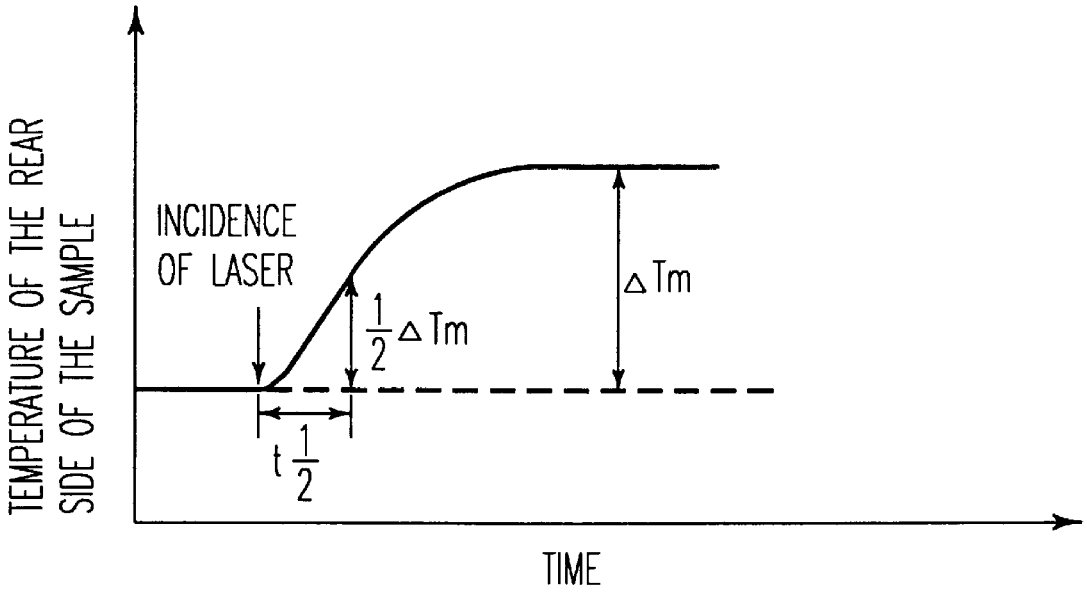
FIG. 4 is a graph illustrating the method for determining the thermal conductivity.

The thickness of the CFRP was changed depending upon the thermal conductivity of the carbon fibers. A test sample with a high thermal conductivity was made thick, and a test sample with a low thermal conductivity was made thin. Specifically, it takes about a few tens msec until the temperature of the rear side of the test sample increases to the maximum temperature after irradiation with a laser, and the thickness of CFRP was adjusted so that the time $t_{1/2}$ until the temperature rises to ½ of the temperature rising width Δ Tm at that time, would be at least 10 msec (the maximum: 15 msec) (See FIG. 4).

The specific heat was determined by bonding glassy carbon as a light-receiving plate to the front side of a test sample and measuring the temperature rise after irradiation with a laser, by a R thermocouple bonded to the center of the rear side of the test sample. The measured value was corrected by using sapphire as the standard sample.

The diffusivity of heat was determined by forming a covering film on both sides of a test sample by a carbon spray until the surface became invisible and measuring the temperature change on the rear side of the test sample after irradiation of a laser, by an infrared ray detector.

Further, the thermal conductivity of the carbon fibers can also be determined from the electrical resistivity by utilizing a very good interrelation between the thermal resistivity and the electrical conductivity of the carbon fibers by the following formula:

$$K=1272.4/ER-49.4$$

wherein K is the thermal conductivity (W/m·K) of the carbon fibers, and ER is the electrical resistivity ($\mu\Omega$m) of the carbon fibers.

EXAMPLE 1

Figure 5:
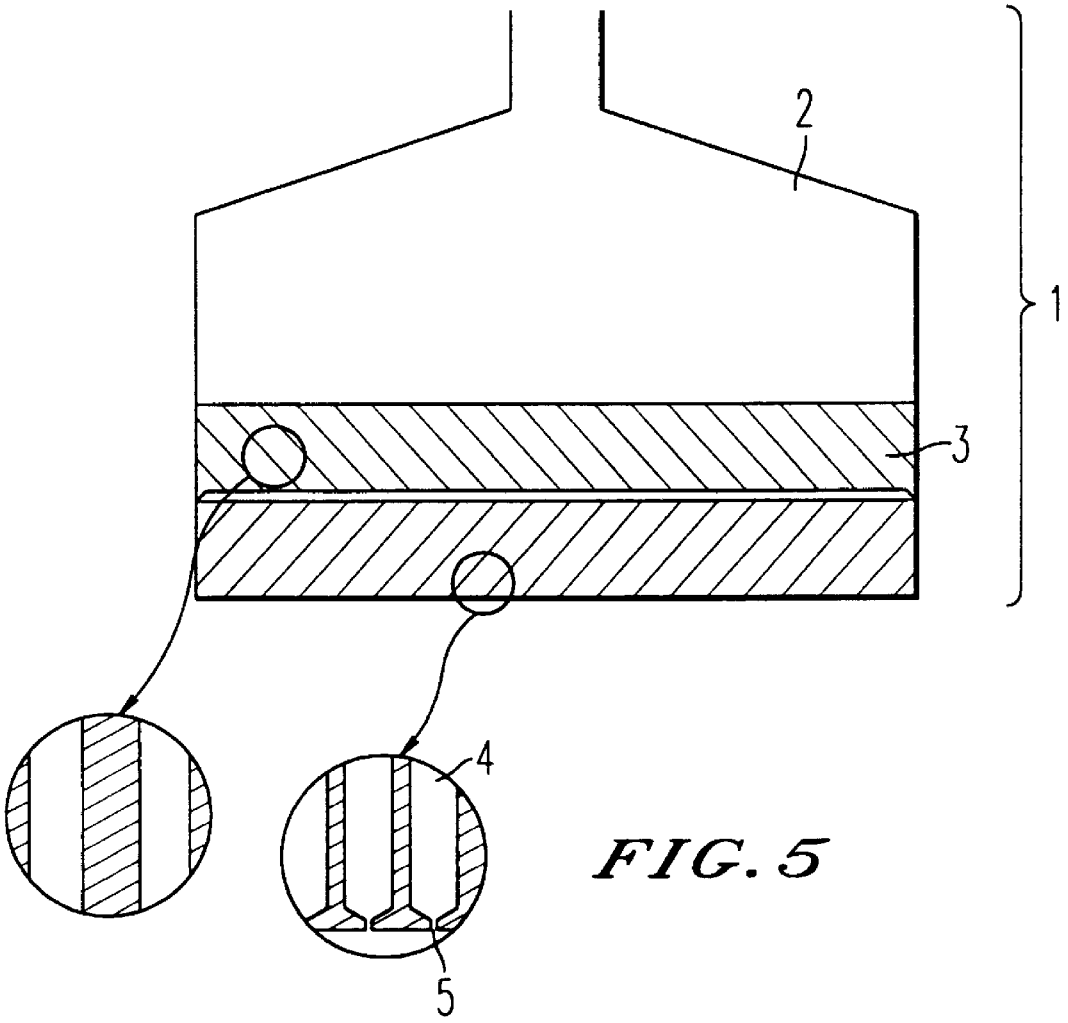
FIG. 5 is a diagrammatical view of the cross section of a spin pack to be used in the process for producing carbon fibers of the present invention.

Spinning pitch having a proportion of optical anisotropy of 100% and a softening point of 300° C., made of coal tar pitch as the starting material, was continuously passed through a filter with openings of 325 mesh to remove impurities and insoluble substances, and then fed into a spin pack (1 in FIG. 5) having 525 spinning nozzles (inlet angle θ=150°, L/D=1, where L is the length of each nozzle hole, and D is the diameter thereof). The pitch was left to stand still for 55 minutes at a linear velocity of 0.1 cm/min in a space (2 in FIG. 5) provided at an upper portion in the spin pack, and then fed into nozzle holes (5 in FIG. 5) via a current plate (3 in FIG. 5) having flow passages of 3 mm in diameter and nozzle inlets (4 in FIG. 5). Spinning was carried out in a stabilized condition, and continuous spinning of at least 15,000 m was possible. The viscosity of the pitch in the spin pack was 250 poise.

Obtained pitch fibers were stepwise heated to 380° C. in air for infusibilizing treatment, and then finally continuously graphitized to a temperature of 2,500° C. in argon gas. Then, obtained fibers were wound on a graphite bobbin and put into a graphite crucible so that they were embedded in preliminarily graphitized packing coke, followed by graphitization treatment at 3,000° C. by an Acheson resistance heating furnace. The retention time at 3,000° C. was one hour. After cooling, while continuously withdrawing the obtained carbon fibers from the graphite bobbin, electrolytic oxidation was carried out for surface treatment, and an epoxy type sizing agent was applied in an amount of 2%.

The obtained carbon fibers had an electrical resistivity of 1.13 $\mu\Omega$m, and the thermal conductivity obtained from the electrical resistivity was 1080 W/m·K. The tensile strength of the strand thereof was 350 kg/mm$^2$, the tensile modulus was 95 ton/mm$^2$, the compression strength was 31 kg/mm$^2$, and the interlaminar hear strength was 3.5 kg/mm$^2$.

As a result of the observation of the cross sectional structure of the fibers, the ratio of crack-free fibers to cracked fibers was 15/85.

EXAMPLE 2

Carbon fibers were prepared in the same manner as in Example 1 except that the viscosity of the pitch in the spin pack was 150 poise, and the retention time was 45 minutes.

The obtained carbon fibers had an electrical resistivity of 1.06 $\mu\Omega$m and the thermal conductivity obtained from the electrical resistivity was 1,150 W/m·K. The tensile strength of the strand thereof was 350 kg/mm$^2$, the tensile modulus was 96 ton/mm$^2$, and the compression strength was 31 kg/mm$^2$.

As a result of the observation of the cross sectional structure of the fibers, the ratio of crack-free fibers to cracked fibers was 10/90.

EXAMPLE 3

Carbon fibers were prepared in the same manner as in Example 1, except that the viscosity of the pitch in the spin pack was 300 poise, and the retention time was 80 minutes.

The obtained carbon fibers had an electrical resistivity of 1.10 $\mu\Omega$m, and the thermal conductivity obtained from the electrical resistivity was 1110 W/m·K. Further, the tensile strength of the strand thereof was 380 kg/mm$^2$, the tensile modulus was 95 ton/mm$^2$, and the compression strength was 32 kg/mm$^2$.

As a result of the observation of the cross sectional structure of the fibers, the proportion of crack-free fibers to cracked fibers was 25/75.

Comparative Example 1

Carbon fibers were prepared in the same manner as in Example 1 except that after removing impurities and insoluble substances by passing the optically anisotropic pitch through a filter with openings of 325 mesh, the pitch was left to stand still in the spin pack for 5 minutes.

The obtained carbon fibers had an electrical resistivity of 1.17 $\mu\Omega$m, and the thermal conductivity obtained from the electrical resistivity was 1040 W/m·K. However, the tensile strength of the strand thereof was as low as 300 kg/mm$^2$, the tensile modulus was as low as 90 ton/mm$^2$, and the compression strength was as low as 27 kg/mm$^2$.

As a result of the observation of the cross sectional structure of the fibers, the proportion of crack-free fibers to cracked fibers was 0/100.

Comparative Example 2

Carbon fibers were prepared in the same manner as in Example 1 except that a 500 mesh filter was disposed immediately before the nozzles. The time from the 500 mesh filter to the nozzle holes was two seconds. namely, the optically anisotropic pitch which was once left to stand still, was again subjected to a shearing force to divide the domains immediately before the nozzles, and spinning was carried out in that state.

The obtained carbon fibers had an electrical resistivity of 1.90 $\mu\Omega$m, and the thermal conductivity obtained from the electrical resistivity was as low as 620 W/m·K.

As a result of the observation of the cross sectional structure of the fibers, the ratio of crack-free fibers to cracked fibers was 97/3.

Comparative Example 3

Spinning was attempted in the same manner as in Example 1 except that the viscosity of the pitch in the spin pack was changed to 20 poise, and the time for standing still was changed to 50 minutes. However, bubble breakage due to a decomposition gas occurred in the stretching step of pitch fibers immediately after being discharged from the nozzles, and continuous spinning was impossible.

Comparative Example 4

Spinning was attempted in the same manner as in Example 1 except that the viscosity of the pitch in the spin pack was 150 poise, and the time for standing still was changed to 360 minutes. However, like in Comparative Example 3, bubble breakage due to a decomposition gas occurred during the stretching step of pitch fibers immediately after being discharged from the nozzles, and continuous spinning was impossible.

Comparative Example 5

The physical properties of THORNEL® K1100X, manufactured by Amoco Company which has the highest thermal conductivity among commercially available pitch based carbon fibers, were measured in accordance with the same measuring methods as in Examples of the present invention. The compression strength was as low as 27 kg/mm$^2$, although the electrical resistivity was 1.16 $\mu\Omega$, the thermal conductivity was 1050 W/m·K, the tensile strength was 300 kg/mm$^2$ and the tensile modulus was 98 ton/mm$^2$.

Further as a result of the observation of the cross sectional shape of the fibers, the ratio of crack-free fibers to cracked fibers was 0/100.

According to the present invention, it is possible to provide carbon fibers having high strength and ultra high thermal conductivity which has not been attained heretofore.

Such high performance carbon fibers are useful particularly as reinforcing fibers for fiber-reinforced plastics to be used not only in the sports and leisure fields, but also in the field of aeronautics and space. Thus, they are industrially very useful.

We claim:

1. Pitch based carbon fibers characterized in that their thermal conductivity is at least 1,000 W/m·K as measured at room temperature, their electrical resistivity is at most 1.2 $\mu\Omega$m, their tensile modulus is at least 95 ton/mm$^2$, their compression strength is at least 30 kg/mM$^2$, and the ratio of crack-free fibers to cracked fibers is from 5/95 to 30/70, where the crack-free fibers are fibers having no cracks in their cross section, and the cracked fibers are fibers having cracks in their cross section.

2. The pitch based carbon fibers according to claim 1, wherein the thermal conductivity is at least 1,050 W/m·K as measured at room temperature.

3. The pitch based carbon fibers according to claim 1, wherein the electrical resistivity is at most 1.15 $\mu\Omega$m.

4. A process for producing carbon fibers according to claim 1, which comprises introducing a molten optically anisotropic pitch into nozzles for spinning, and subjecting pitch fibers thereby obtained to infusibilization, carbonization or graphitization, wherein the molten optically anisotropic pitch is left to stand still for from 20 to 300 minutes in such a state that the viscosity is from 50 to 1,000 poise, and then the pitch is directly introduced into the nozzles for spinning.

5. The process for producing carbon fibers according to claim 4, wherein the optically anisotropic pitch has an optical anisotropy of at least 70%.

6. The process for producing carbon fibers according to claim 4, wherein the optically anisotropic pitch has an optical anisotropy of at least 90%.

7. The process for producing carbon fibers according to claim 4, wherein the optically anisotropic pitch has a softening point of from 260° to 340° C. as measured by a Metler method.

8. The process for producing carbon fibers according to claim 4, wherein the molten optically anisotropic pitch is left to stand still in such a state that the viscosity is from 100 to 500 poise.

9. The process for producing carbon fibers according to claim 4, wherein the molten optically anisotropic pitch is left to stand still for from 40 to 150 minutes.

10. The process for producing carbon fibers according to claim 4, wherein the molten optically anisotropic pitch is continuously supplied to a spinning apparatus at a linear velocity of at most 2 cm/min.

11. The process for producing carbon fibers according to claim 4, wherein the nozzles have a nozzle hole inlet angle $\alpha$ of larger than 70° and a L/D ratio of smaller than 3, where L is the length of each nuzzle hole, and D is the diameter of each nozzle hole.

12. The process for producing carbon fibers according to claim 4, wherein the pitch fibers are infusibilized and then carbonized or graphitized at a temperature of from 800° to 3,000° C. to obtain carbon fibers, and further, the carbon fibers are wound on a graphite bobbin or core material, then put in a graphite crucible and subjected to high graphitization treatment at a temperature of from 1,400° to 3,500° C. for from 30 minutes to 300 days.

* * * * *